United States Patent [19]

Stanaitis

[11] 3,967,875

[45] July 6, 1976

[54] CAPTIVE FASTENER AND CAPTIVE WASHER ASSEMBLY

[75] Inventor: Peter P. Stanaitis, Rockford, Ill.

[73] Assignee: Textron, Inc., Providence, R.I.

[22] Filed: Mar. 10, 1975

[21] Appl. No.: 556,716

[52] U.S. Cl. ..... 339/263 R; 151/37

[51] Int. Cl.[2] ..... H01R 7/16

[58] Field of Search ..... 339/242, 246, 263 R, 339/269, 271; 85/50 R; 151/35, 37

[56] References Cited

UNITED STATES PATENTS

| | | | |
|---|---|---|---|
| 2,372,653 | 4/1945 | Becket | 339/263 R |
| 3,777,796 | 12/1973 | Takano | 85/50 R |
| 3,882,752 | 5/1975 | Gutshall | 85/80 R |

FOREIGN PATENTS OR APPLICATIONS

| | | | |
|---|---|---|---|
| 1,198,187 | 7/1970 | United Kingdom | 85/50 R |

*Primary Examiner*—Roy Lake
*Assistant Examiner*—Mark S. Bicks
*Attorney, Agent, or Firm*—Olson, Trexler, Wolters, Bushnell & Fosse, Ltd.

[57] ABSTRACT

A terminal assembly is disclosed for effecting connection with an electrically conductive element such as a lead or antenna wire or a spade type terminal mounted to the end of such a conductor wire. The disclosed assembly comprising a screw fastener having a clamping washer mounted thereon, which fastener is engageable with an internally threaded element providing a clamping surface opposing said washer. Said washer is provided with a central aperture, an intermediate section surrounding said aperture and an axially extending clamping flange. The intermediate section of said washer includes an inwardly tapered segment which is engageable against abutment means on the fastener shank, which abutment means and the driving head on said fastener serves to limit the movement of the washer relative to the fastener shank. Accordingly, movement of the fastener relative to the support surface will produce almost immediate movement of said washer relative to said support surface.

10 Claims, 5 Drawing Figures

CAPTIVE FASTENER AND CAPTIVE WASHER ASSEMBLY

BACKGROUND OF THE INVENTION

The present invention relates to a washer and screw fastener assembly, wherein the washer is held captive thereon; and more specifically, to a preassembled washer and screw assembly of the type employed to provide an electrical terminal for appliances, or the like.

It is relatively common practice to employ preassembled screw fasteners and washers as electrical terminals in numerous types of assemblies such as telephones, household appliances and television sets, wherein the terminals are used for attaching lead wires and/or antenna wires. In this regard the conductive elements, such as metal terminals crimped onto the end of lead or antenna wires, are positioned beneath the captive washer, and the fastener is then seated to bring the washer into clamping engagement with the terminal. In practice, the threaded fastening device, or the surface against which the lead wire is engaged is in conducting relationship with the interior circuitry of the device. Generally, the type of washer employed is that which includes an axially extending peripheral flange, which in many instances is serrated to enhance the gripping or clamping contact.

These terminal assemblies are generally of the "Sems" type, in that the washer is held captive upon the screw fastener by the screw thread or some other structural configuration of the fastener, which is formed on the fastener blank subsequent to assembly of the washer thereon.

While Sems type assemblies have been employed for a considerable time as terminals, they are generally of the type as shown in FIG. 1 of the drawings, and as such possess certain inherent disadvantages. As these prior art assemblies normally employ a washer having an axially extending peripheral flange, the engagement of the thread forming dies with the shank of the fastener is limited by the axially projecting flange. As will be explained more fully hereinafter with regard to the detailed description of the prior art and the present invention, this fact results in a relatively long unthreaded section which permits considerable relative movement or "play" between the washer and the screw shank. Keeping in mind that terminals are normally employed in a vertical orientation, the extent to which the screw fastener must be backed out of a mating aperture, in order to raise the washer sufficiently to allow for positioning of the terminal beneath the washer, is increased by the degree of play or relative movement between the washer and the shank. That is to say, the retracting movement of the fastener must overcome this play, before the washer is elevated above the adjacent supporting surface. As such, there exists the distinct possibility that the fastener may be backed completely out of the aperture, which will require re-engagement and loss of assembly time. Also, the amount of movement of the screw fastener relative to a threaded aperture required in the operation is considerable and can effect the overall assembly time; which is significant since numerous such assembly operations must be performed. The present invention eliminates, or at least materially reduces these disadvantages.

More specifically, with the present invention the washer is provided with an intermediate portion about the central aperture that includes an inwardly and downwardly tapered segment, which may take the form of a generally frusto-conical configuration. The net effect of this, is that the central aperture is moved axially toward the plane of the edge of the axially extending flange, and away from the plane of the upper portion of the washer. Thus, as will be apparent from a comparison of FIGS. 1 and 2 and the discussion to follow, the play between the washer and the fastener is materially reduced. Accordingly, upon retractive movement of the fastener, elevation of the washer in relation to the adjacent supporting surface will take place almost immediately.

The present invention is possessed with numerous other objects, advantages and features which will become apparent to those skilled in the art from the hereinafter presented detailed description of the illustrated embodiment, taken in conjunction with the drawings.

DESCRIPTION OF THE ILLUSTRATED EMBODIMENT

Figure 1:
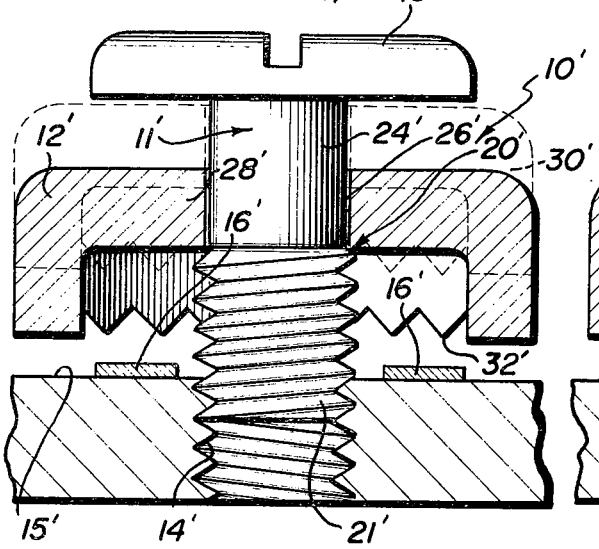
FIG. 1 (PRIOR ART)
FIG. 1 is a partial, sectional view of a prior art type of fastener assembly, engaged with an internally threaded element.
Figure 2:
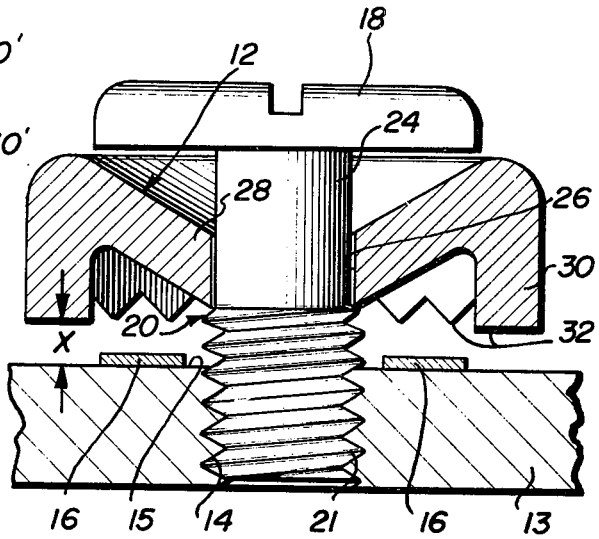
FIG. 2 is a partial, sectional view of the fastener assembly of the present invention engaged with a threaded element, and in the backed out or elevated position.

Attention is invited to the drawings, wherein a comparison between the prior art type of terminal assembly, FIG. 1, and that of the present invention, FIG. 2, can be had. Initially, the discussion will be directed to the prior art assembly of FIG. 1 with the elements and features thereof being designated by substantially the same general reference characters as those employed with regard to the present invention of FIG. 2, with the addition of a prime (′) designation.

FIG. 1 illustrates the typical prior art type of sems terminal fastener assembly, designated generally 10′, which includes a fastener element 11′ having a washer 12′ mounted thereon. The fastener assembly 10′ is engaged with a cooperating workpiece or element 13′ having an internally threaded aperture 14′ and an upper support or clampimg surface 15′, with a conductive element or metal terminal 16′ (illustrated in section) positioned thereon. As can be seen, the fastener 11′ can be moved inwardly of the threaded bore 14′ to bring the washer 12′ into clamping engagement with the conductive element 16′.

The fastener 11′ includes a driving head 18′, a shank portion 20′ having a threaded end segment 22′ and an unthreaded neck portion 24′. The washer 12′ is held captive on the unthreaded neck portion 24′ by the screw thread 22′ and the driving head 18′.

The washer 12′, as shown in FIG. 1, includes a central aperture 26′, surrounded by an intermediate, substantially flat body portion 28' having a peripheral, axially extending flange portion 30'. Preferably the peripheral axially extending flange 30' will include a serrated edge 32' to enhance the clamping engagement with the conductor element 16'.

As was mentioned above, and as will be discussed hereinafter with regard to FIGS. 4 and 5, the fastener assembly of the present invention, as well as that of the prior art is what is termed a "sems" type of assembly. That is to say, the washer 12' is assembled upon an unthreaded blank, and the screw thread 21' or some other structure formed thereon to a diameter greater than the diameter of the aperture 26' in the washer 12', thereby rendering the washer 12' captive upon the blank. This operation takes place through the use of dies which cold form the threaded portion 22'. Due to the presence of the peripheral flange 30' however, the extent of engagement of the rolling die with the shank 20' is limited to a point generally in alignment with the plane of the serrated edge 32'. Thus, the length of the unthreaded segment 24' will be considerably greater than the thickness of the intermediate section 28' resulting in that the washer 12' being free to move relative to the shank, as indicated in dotted outline.

As alluded to previously, this freedom of movement or play, is a disadvantage, in that the fastener 11' must be backed out of the aperture 14' initially an amount equal to the extent of said play before the thread 22' is brought into engagement with the aperture 26' and movement of the serrated edge 32' away from support surface 15' is attained. Additional backing out or retractive movement of the fastener 11' will produce movement of the washer 12' away from the support surface 15', a sufficient distance X to enable a worker to properly position the terminal element 16' for subsequent clamping.

The net result of this, is that a considerable amount of relative movement of the fastener 11' with respect to the aperture 14' must be effected, all of which is time consuming. In addition, if the length of the threaded portion 22' is maintained as short as possible to conserve material, there is a distinct danger that the fastener will become completely disengaged from the threaded aperture 14', thus resulting in additional loss of assembly time.

Attention is now invited to FIG. 2, wherein the terminal fastener assembly 10 of the present invention is illustrated. In this regard, the fastener assembly 10 includes a fastener element 11 having a washer element 12 held captive thereon. The fastener element 11, similar to that of FIG. 1, including a driving head 18, a shank 20 comprised of an unthreaded neck portion 24 and a threaded end portion 22.

The washer 12 is also generally similar to that as discussed with regard to FIG. 1, in that there is provided a peripheral, axially extending flange 30, having a serrated edge 32. Washer 12 of the present invention differs from that as previously discussed, in that the intermediate section 28 which surrounds and defines the central aperture 26 is of a generally frusto-conical configuration, extending axially in the same direction as the flange 30, toward the threaded portion 22. The net effect of this, is to dispose the central aperture 26 axially toward the plane of the serrated edge 32 of the washer, and away from the upper edge or plane of the peripheral surface of the intermediate section 28.

In practice, the unthreaded shank portion 24 is preferably sized so that it is approximately equal to the overall axial length of the washer 12, with the lowermost edge of the aperture 26 being positioned approximately at, or slightly above the plane of the serrated edge 32. Thus, when the washer 12 is assembled, as shown in FIG. 1, the degree of play or axial movement of the washer relative to the fastener 11, is reduced considerably, if not completely eliminated. Accordingly, immediately upon backing of the fastener element 11 out of the threaded aperture 14, the central aperture 26 will be engaged by the threaded portion 20 and movement of the washer away from the support surface 15 will be attained.

By way of comparison of the present invention with the prior art embodiment of FIG. 1, attention will now be invited to the differences existing between the illustrations of FIGS. 1 and 2. Assuming that the washer 12' must be elevated a distance X in order to permit positioning of the lead wire or terminal preparatory to clamping, it can be seen that considerably more retractive movement of the assembly 10' is required to achieve the elevation X than is required of the assembly 10 of the present invention. As mentioned previously, this is due to the fact that the play or degree of movement between the washer and the fastener of the prior art embodiment 10' must be overcome before the washer is elevated relative to the support surface 15'.

Figure 3:
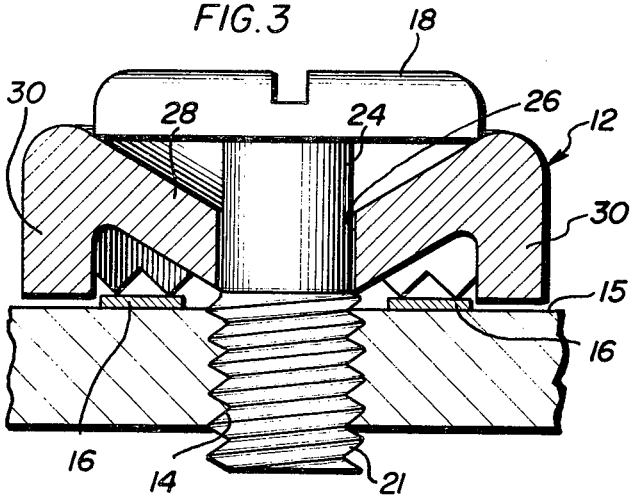
FIG. 3 is a partial, sectional view similar to FIGS. 1 and 2 illustrating the clamping condition wherein the washer is in clamped engagement with an electrical terminal element.

Looking now to FIG. 3, there is shown a condition which will exist when the fastener assembly 10 of the present invention is employed in the clamping position. In this regard, it can be seen that the serrated edge 32 will firmly engage the conductive element 16 and clamp this element against the support surface 15. Similarly, as less movement is required to achieve the elevated position of the washer, correspondingly less movement is required of the assembly 10 to achieve the clamping position. Here again, even as the play between the washer and the fastener element must be overcome in elevating the washer, this play must also be overcome in properly seating the fastener element.

As an additional feature, it should be noted that given approximately the same length of the threaded segments 22' and 22, and assuming elevation of the washer to a height "X", the fastener element 11 will have more thread turns engaged than will the fastener 11'. Thus, with the fastener 11 of the present invention, any danger of unseating of the fastener element from the threaded aperture is materially reduced.

Figure 4:
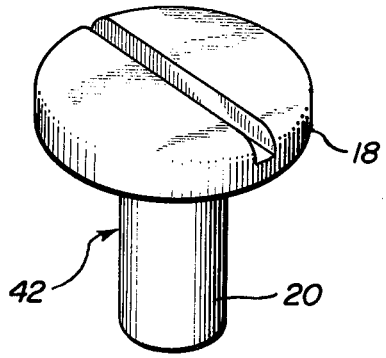
FIG. 4 is an exploded view, partially in section, illustrating the blank and washer employed in fabricating the assembly as shown in FIGS. 2 and 3.
Figure 5:
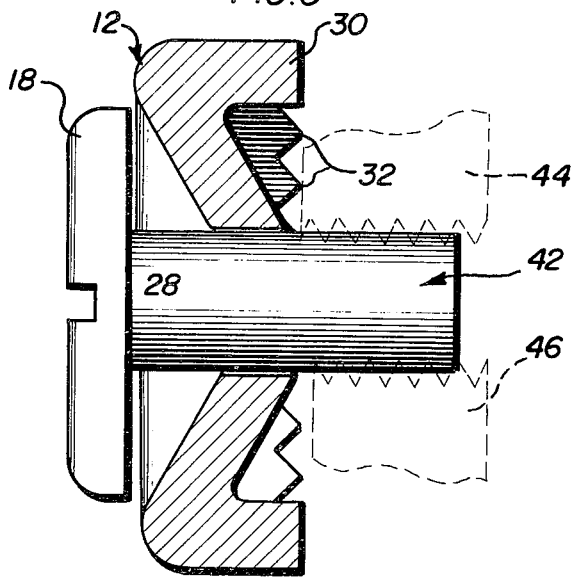
FIG. 5 is a schematic view, illustrating the manner in which the external thread is formed upon the fastener assembly of FIGS. 1 and 2.
Figure 5:
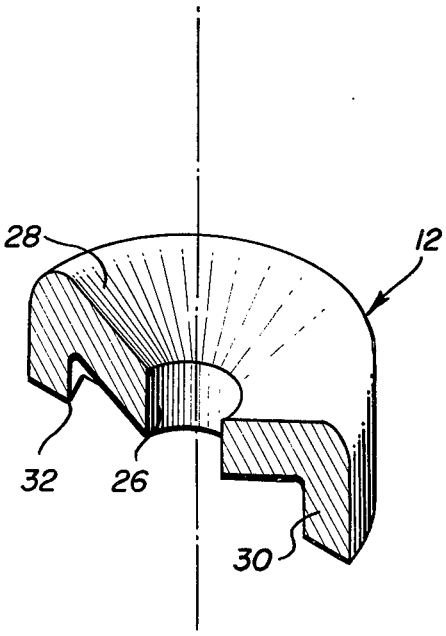

FIGS. 4 and 5 illustrate the manner in which the fastener assembly 10 of the present invention is fabricated. In this regard, an unthreaded blank designated generally 42, is provided, with the driving head 18 previously formed thereon. The blank 42 is assembled with a washer 12, the aperture 26 in said washer being sized to easily accept the shank 20 of blank 42 without interference. The assembled blank 42 and washer 12 are then engaged between a pair of thread rolling dies 44 and 46, illustrated schematically in FIG. 5 in phantom outline. Relative movement between the dies 44 and 46 is employed, in conjunction with clamping action, to bring the forming surfaces of the dies into deforming relation with the shank 20, thereby cold-rolling the thread 22 thereon. Since the forming operation employs cold-rolling, an upsetting of the material is achieved, resulting in formation of a thread having a major diameter greater than the original diameter of the shank 20. The aperture 26 in washer 12 is selected to be less than the major diameter of the thread 22, so that the washer 12 is in effect held captive between the last thread turn and the head 18.

The above discussion, presented in conjunction with the drawings, discloses a preferred embodiment of the present invention. It is envisioned by Applicant, that those skilled in the art and provided with the present disclosure may well devise various changes, additions or modifications which vary somewhat from the structure of the disclosed embodiment; for example, rather than employment of a frusto-conical intermediate portion, only one or more segments thereof need be tapered inwardly, or an assembly method for holding the washer 12 captive on the fastener, other than that as illustrated in the drawings may be employed. As such, it is not Applicant's intention to limit the present invention to the disclosed embodiment, but rather that said invention be defined and interpreted in light to the spirit and scope of the claims appended hereto.

I claim:

1. A threaded terminal fastener assembly of the type engageable with an internally threaded element to effect clamping of an electrically conductive element, said assembly comprising a screw fastener element and an apertured clamping washer captively mounted on said fastener element, said screw fastened element having a driving head portion, and an elongate shank, said shank including an externally threaded portion and an unthreaded neck portion disposed intermediate said driving head portion and said threaded portion, said unthreaded portion having the apertured clamping washer element mounted thereon, said washer including an axially extending peripheral flange, an intermediate portion joined with said peripheral flange and extending radially inward thereof and defining a centrally disposed aperture, the improvement, wherein said intermediate portion includes at least a segment thereof which is tapered radially inward and extends in the same direction as said peripheral flange, said tapered segment terminating at a location spaced axially of the point of juncture of said peripheral flange and said intermediate section, said segment engaging means on said fastener to maintain said clamping washer and said fastener in assembly.

2. An assembly according to claim 1, wherein said intermediate section of said washer including said tapered segment is of a frusto-conical configuration, thereby disposing said washer aperture at a location proximate the plane of the edge of said axially extending peripheral flange portion.

3. An assembly according to claim 1, wherein said axially extending peripheral flange is provided with a serrated edge to enhance the clamping ability thereof.

4. An assembly according to claim 1, wherein said washer aperture is of lesser diameter than the major diameter of said threaded portion on said shank, and said threaded portion providing the means against which said tapered segment engages.

5. A washer element for use with a terminal fastener assembly comprised of a threaded fastener and said washer mounted thereon, said washer element including a central aperture adapted to receive a portion of said fastener element, an intermediate section disposed about said aperture and extending generally to the periphery of said washer element, and a peripheral flange joined to and extending axially of said intermediate segment, the edge of said flange adapted to be brought into engagement with a conductive element to clamp same between said washer and a support surface, the improvement, wherein said intermediate section of said washer includes a radially inwardly tapered segment extending axially in the same direction as said peripheral flange and defining at least a portion of said central aperture, which tapered segment is disposed axially of the juncture of said peripheral flange and said intermediate section and adapted to engage limiting means on a mating fastener element to limit movement of said washer relative to said fastener element.

6. An assembly according to claim 5, wherein said intermediate section of said washer including said tapered segment is of a frusto-conical configuration, thereby disposing said washer aperture at a location proximate the plane of the edge of said axially extending flange.

7. An assembly according to claim 5, wherein said axially extending flange is provided with a serrated edge to enhance the clamping ability thereof.

8. A threaded terminal fastener assembly of the type engageable with an internally threaded element to effect clamping of an electrically conductive element, said assembly comprising a screw fastener element having a driving head portion, and an elongate shank, said shank including an externally threaded portion and an unthreaded neck portion disposed intermediate said driving head portion and said threaded portion, said unthreaded portion having a diameter less than the major diameter of said threaded portion; and an apertured washer element mounted on said reduced diameter neck portion, said washer having a central aperture which is of less diameter than the major diameter of said threaded portion thereby rendering said washer captive thereon, said washer further including an intermediate section disposed about said aperture and joined with an axially extending peripheral flange portion, said intermediate section including at least a segment thereof which is tapered radially inwardly and extends axially in the same direction as said peripheral flange, which segment is of frusto-conical configuration, converging radially inwardly in an axial direction toward said threaded portion, thereby to dispose said central aperture proximate the plane of the edge of said peripheral flange, whereby said aperture will be disposed proximate said threaded portion, such that the degree of relative movement between said fastener and said washer is limited.

9. A terminal arrangement adapted for the connecting of an electrically conductive element thereto, said terminal arrangement comprising: a fastener assembly including a threaded fastener element and a clamping washer captively mounted thereon, an internally threaded structure means including a threaded aperture for receipt of said fastener element and a support surface against which said conductive element may be clamped by said washer, said fastener element having a driving head portion, and an elongate shank, said shank including an externally threaded portion and an unthreaded neck portion disposed intermediate said driving head portion and said threaded portion, said unthreaded portion having said washer mounted thereon, said clamping washer having a central aperture, an intermediate section disposed about said aperture, and an axially extending peripheral flange portion joined with said intermediate section, the improvement wherein said intermediate section includes at least a segment thereof which is tapered radially inwardly and extends axially in the same direction as said peripheral flange, which segment terminates at a location spaced axially of the point of juncture of said flange portion and said intermediate section will engage means on said shank to limit the movement of said washer relative to said fastener shank.

10. The combination according to claim 9, wherein said intermediate section is of a frusto-conical configuration converging toward said threaded portion, thereby disposing said central aperture of said washer axially inward of the upper surface portion of said washer, with the length of said unthreaded shank portion from said means holding the washer captive thereon to said driving head being only slightly greater than the distance from the plane of said upper portion to the lowermost edge of said aperture, whereby axial movement of said washer relative to said shank is limited by said driving head and said means.

* * * * *